US011647798B2

(12) United States Patent
Ross

(10) Patent No.: US 11,647,798 B2
(45) Date of Patent: May 16, 2023

(54) BRASSIERE HAVING STRAPS TO WRAP AROUND A USER'S SHOULDERS

(71) Applicant: Zakenya Ross, Frederiksted St Croix, VI (US)

(72) Inventor: Zakenya Ross, Frederiksted St Croix, VI (US)

( * ) Notice: Subject to any disclaimer, the term of this patent is extended or adjusted under 35 U.S.C. 154(b) by 0 days.

(21) Appl. No.: 15/954,620

(22) Filed: Apr. 17, 2018

(65) Prior Publication Data

US 2019/0313707 A1 Oct. 17, 2019

(51) Int. Cl.
*A41C 3/00* (2006.01)

(52) U.S. Cl.
CPC ..... *A41C 3/0078* (2013.01)

(58) Field of Classification Search
CPC ..... A41C 3/0078
USPC ..... 450/86
See application file for complete search history.

(56) References Cited

U.S. PATENT DOCUMENTS 3,109,431 A * 11/1963 Jefferson ..... A41C 3/0007 450/48
3,216,425 A * 11/1965 De Keersmaecker ..... A41C 3/0078 450/1
4,418,696 A * 12/1983 Delet ..... A41C 3/0078 450/52
D433,786 S * 11/2000 Gladstone ..... D2/706
6,547,636 B1 * 4/2003 Cato ..... A41C 3/0028 450/86
D492,089 S * 6/2004 Flannery ..... D2/706
7,168,096 B1 * 1/2007 Landa ..... A41C 3/0021 2/67
D629,587 S * 12/2010 Tena ..... D2/706
8,337,275 B2 * 12/2012 Martins-Crawbuck ..... A41C 3/0028 450/62
9,961,944 B2 * 5/2018 Fayad ..... A41C 3/0028
2011/0081827 A1 * 4/2011 Williams ..... A41C 3/0021 450/65
2013/0237124 A1 * 9/2013 Hall ..... A41C 3/00 450/38

* cited by examiner

*Primary Examiner* — Gloria M Hale
(74) *Attorney, Agent, or Firm* — The Iwashko Law Firm, PLLC; Lev Ivan Gabriel Iwashko

(57) ABSTRACT

A brassiere, including a first cup to support a first breast of a user, a first strap to extend from the first cup to wrap around a first shoulder of the user, a second cup to support a second breast of the user, and a second strap to extend from the second cup to wrap around a second shoulder of the user.

4 Claims, 2 Drawing Sheets

BRASSIERE HAVING STRAPS TO WRAP AROUND A USER'S SHOULDERS

BACKGROUND

1. Field

The present general inventive concept relates generally to a brassiere, and particularly, to a brassiere having straps to wrap around a user's shoulders.

2. Description of the Related Art

Oftentimes, a strappy, backless dress can be the perfect look for a night out or a party. However, most brassieres (bras) are generally not up to the task, as most of them have backs, and those which are "backless" can often involve sticky, painful adhesives needing to be stuck directly to a user's skin.

Therefore, there is a need for a strapped brassiere that is comfortable, supportive, and aesthetically pleasing when a user wears a backless dress.

SUMMARY

The present general inventive concept provides a brassiere having straps to wrap around a user's shoulders.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a brassiere, including a first cup to support a first breast of a user, a first strap to extend from the first cup to wrap around a first shoulder of the user, a second cup to support a second breast of the user, and a second strap to extend from the second cup to wrap around a second shoulder of the user.

The first strap may include a first end to extend from an outer side portion of the first cup, and a second end to extend from a top portion of the first cup.

The second strap may include a first end to extend from an outer side portion of the second cup, and a second end to extend from a top portion of the second cup.

The brassiere may further include a support portion disposed at a bottom portion of the first cup and the second cup, such that the first cup is connected to the second cup.

A first end of the first strap may be connected to a first end of the second strap via the support portion.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
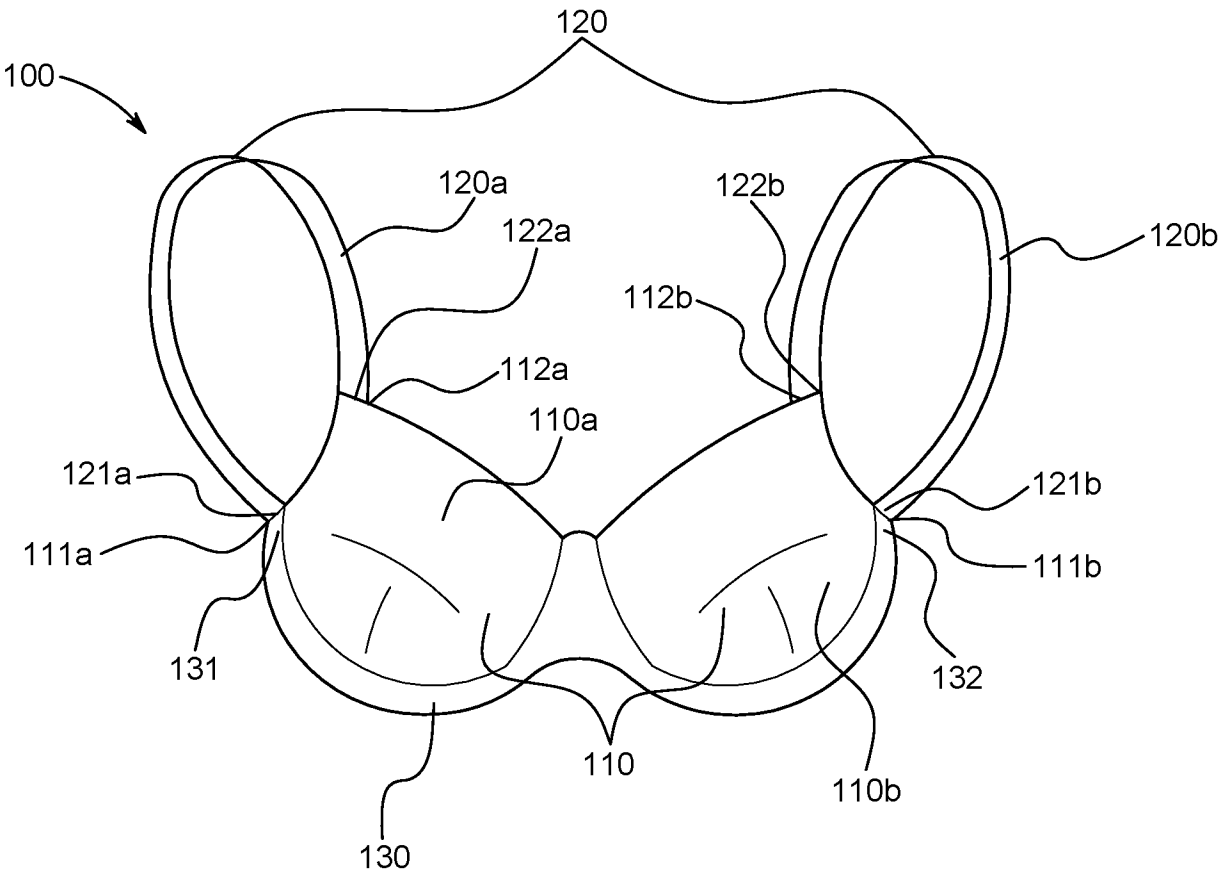
FIG. 1 illustrates a front view of a brassiere, according to an exemplary embodiment of the present general inventive concept.

FIG. 1 illustrates a front view of a brassiere 100, according to an exemplary embodiment of the present general inventive concept.

The brassiere 100, and components thereof, may be constructed from spandex, lycra-spandex, cloth, polyester, cotton, wool, rubber, leather, faux-leather, hooks, loops, wiring, VELCRO, adhesives, and any other material known to one of ordinary skill in the art.

Referring to FIG. 1, the brassiere 100 may include cups 110, straps 120, and a support portion 130, but is not limited thereto. More specifically, referring to FIG. 1, the brassiere 100 may include a first cup 110*a*, a second cup 110*b*, a first strap 120*a*, and a second strap 120*b*.

The support portion 130 may outline a bottom portion of the cups 110, and may also be disposed between the cups 110.

Figure 2:
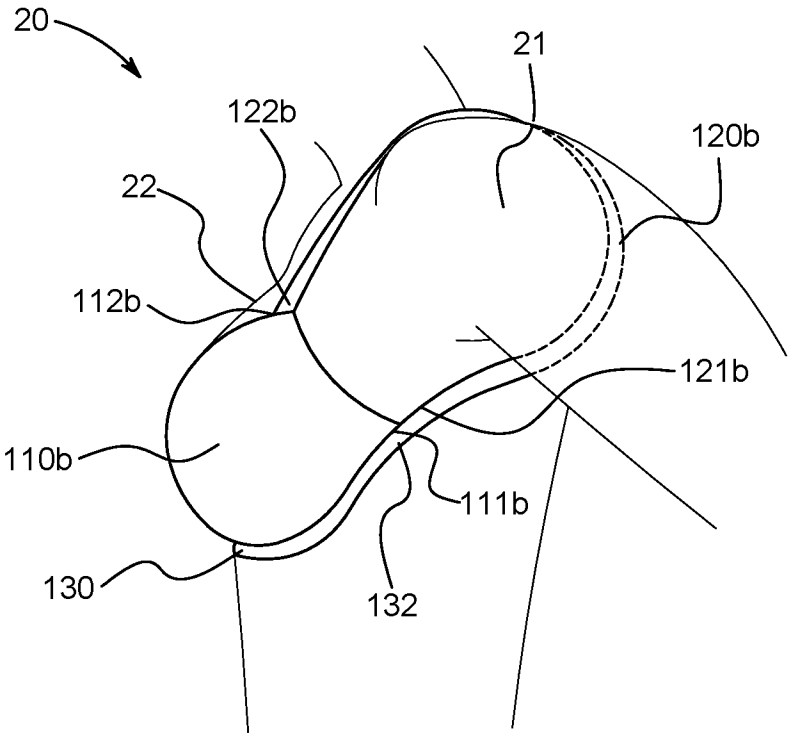
FIG. 2 illustrates a side view of the brassiere as worn by a user, according to an exemplary embodiment of the present general inventive concept.

FIG. 2 illustrates a side view of the brassiere 100 as worn by a user 10, according to an exemplary embodiment of the present general inventive concept.

Referring to FIGS. 1 and 2, the cups 110 may be round, or designed to envelop and/or conform to a user's breasts, in order to support the user's breasts when the brassiere 100 is worn by the user.

The straps 120 may be disposed to extend from outer side portions 111 and upper portions 112 of the cups 110. More specifically, a first end 121*a* of the first strap 120*a* may be disposed at and extend from an outer side portion 111*a* of the first cup 110*a*, and a second end 122*a* of the first strap 120*a* may be disposed at and extend from a top portion 112*a* of the first cup 110*a*. As such, the first end 121*a* may be disposed on or near the second end 122*a*. Similarly, a first end 121*b* of the second strap 120*b* may be disposed at and extend from an outer side portion 111*b* of the second cup 110*b*, and a second end 122*b* of the second strap 120*b* may be disposed at and extend from a top portion 111*b* of the second cup 110*b*. As such, the first end 121*b* may be disposed on or near the second end 122*b*.

Furthermore, the first end 121*a* of the first strap 120*a* may be connected to a first end 131 of the support portion 130, and the second end 121*b* of the second strap 120*b* may be connected to a second end 132 of the support portion 130.

Referring to FIG. 2, the second strap 120*b* may be disposed to fit around a shoulder 21 of the user 20, such that a breast 22 is adequately supported by the second cup 110*b*. The same functionality applies to the first strap 120*a* and the first cup 110*a*.

As such, breasts 22 of the user 20 may be held and supported by the cups 110 which the straps 120 wrap comfortably around shoulders 21 of the user 20, thereby allowing the user 20 to wear a backless dress without having the straps 120 be visible.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A brassiere, comprising:

a first cup to support a first breast of a user;

a first strap to extend from the first cup to wrap around a first shoulder of the user;

a second cup to support a second breast of the user;

a second strap to extend from the second cup to wrap around a second shoulder of the user; and a support portion disposed at a bottom portion of the first cup and the second cup, such that the first cup is connected to the second cup, such that the support portion is larger between the first cup and the second cup, such that the first strap extends from the first cup at a first end of the support portion and the second strap extends from the second cup at a second end of the support portion, such that the support portion only extends a length from a connection of the first strap at the bottom portion of the first cup to a connection of the second strap at the bottom portion of the second cup.

2. The brassiere of claim 1, wherein the first strap comprises:

a first end to extend from an outer side portion of the first cup; and a second end to extend from a top portion of the first cup.

3. The brassiere of claim 2, wherein the second strap comprises:

a first end to extend from an outer side portion of the second cup; and a second end to extend from a top portion of the second cup.

4. The brassiere of claim 1, wherein a first end of the first strap is connected to a first end of the second strap via the support portion.

* * * * *